US008984772B2

(12) United States Patent
Mazzarolo

(10) Patent No.: US 8,984,772 B2
(45) Date of Patent: Mar. 24, 2015

(54) FOOTWEAR WITH SHOCK ADSORBER

(75) Inventor: Giovanni Mazzarolo, Coste di Maser (IT)

(73) Assignee: Alpinestars Research SRL, Coste di Maser (Treviso) (IT)

( * ) Notice: Subject to any disclaimer, the term of this patent is extended or adjusted under 35 U.S.C. 154(b) by 937 days.

(21) Appl. No.: 12/675,596

(22) PCT Filed: Aug. 29, 2007

(86) PCT No.: PCT/IT2007/000595

§ 371 (c)(1),
(2), (4) Date: Feb. 26, 2010

(87) PCT Pub. No.: WO2009/028001

PCT Pub. Date: Mar. 5, 2009

(65) Prior Publication Data

US 2010/0299958 A1 Dec. 2, 2010

(51) Int. Cl.

| | |
|---|---|
| ***A43B 21/30*** | (2006.01) |
| ***A43B 5/14*** | (2006.01) |
| ***A43B 13/14*** | (2006.01) |
| ***A43B 7/32*** | (2006.01) |
| ***A43B 13/18*** | (2006.01) |
| ***A43B 3/24*** | (2006.01) |
| ***A43B 7/14*** | (2006.01) |

(52) U.S. Cl.

CPC ..... *A43B 7/32* (2013.01); *A43B 13/183* (2013.01); *A43B 21/30* (2013.01); *A43B 3/24* (2013.01); *A43B 5/145* (2013.01); *A43B 7/144* (2013.01)

USPC ..... 36/38; 36/72 B; 36/131

(58) Field of Classification Search

CPC ..... A43B 5/145; A43B 7/32; A43B 13/183; A43B 21/30

USPC ..... 36/35 R, 38, 72 B, 96, 131

See application file for complete search history.

(56) References Cited

U.S. PATENT DOCUMENTS

| | | | | |
|---|---|---|---|---|
| 2,519,458 | A | 8/1950 | Hall | |
| 3,122,848 | A * | 3/1964 | Grossman | 36/7.3 |
| 3,214,849 | A * | 11/1965 | Nadaud | 36/37 |

(Continued)

FOREIGN PATENT DOCUMENTS

| | | |
|---|---|---|
| DE | 7917898 U1 | 11/1979 |
| DE | 3111186 A1 | 9/1982 |
| DE | 3712120 A1 | 10/1987 |
| JP | 2000116405 | 4/2000 |

OTHER PUBLICATIONS

"PCT International Search Report dated May 23, 2008 for PCT/IIT2007/000595, from which the instant application is based," 4 pgs.

(Continued)

*Primary Examiner* — Khoa Huynh
*Assistant Examiner* — Sharon M Prange
(74) *Attorney, Agent, or Firm* — Fredrikson & Byron, P.A.

(57) ABSTRACT

A footwear for protecting the foot against an impact with an external body, comprising a protective component (20) adapted to deforming under pressure from the foot and/or the external body in case of impact. The protection component is made in a way to react under said pressure with a permanent and irreversible structural alteration, thus absorbing and simultaneously dispersing the received energy during the impact.

12 Claims, 4 Drawing Sheets

(56) References Cited

U.S. PATENT DOCUMENTS

| | | | | |
|---|---|---|---|---|
| 5,381,608 | A * | 1/1995 | Claveria | 36/35 R |
| 5,396,718 | A * | 3/1995 | Schuler et al. | 36/38 |
| 5,678,327 | A * | 10/1997 | Halberstadt | 36/27 |
| 5,729,916 | A * | 3/1998 | Vorobiev et al. | 36/27 |
| 5,983,529 | A | 11/1999 | Serna | |
| 6,519,874 | B1 * | 2/2003 | Dean | 36/30 R |

OTHER PUBLICATIONS

"PCT International Preliminary Report on Patentability dated Nov. 26, 2009 for PCT/IT2007/000595, from which the instant application is based," 7 pgs.

"PCT Written Opinion dated May 23, 2008 for PCT/IT2007/000595, from which the instant application is based," 5 pgs.

* cited by examiner

FOOTWEAR WITH SHOCK ADSORBER

RELATED APPLICATIONS

This application is a 35 U.S.C. 371 national stage filing from International Application No. PCT/IT2007/000595 filed Aug. 29, 2007, the teachings of which are incorporated herein by reference.

The present invention concerns footwear with a protective component against impact, especially for sports activities such as a motocross boot referred to in the example. However, this invention is also applicable for different footwear such as sandals, slippers, boots etc.

In motorcycling, especially motocross, riders use reinforced boots so as to absorb possible impacts against the ground, other riders or, in case of a crash, against the same motorcycle. Such reinforcements can be provided both on the sides of the footwear, e.g. as plates made of non-deformable material, and on the bottom of the footwear, as thick soles and/or made of rigid material. In case of vertical falls, the rider's foot sole, especially the heel, is particularly subject to heavy impacts which, also due to the rigidity of the same reinforcements, lead to undesired bruises or fractures even. Similarly to motocross, even in other sports such as skateboard, the heel is subject to hard vertical impacts and hence attempts have been made to solve the problem by making footwear with specially shaped heels.

From U.S. Pat. No. 5,983,529, a sole is known which has, in the heel, an insert made up of shock-absorbing elements made of polyurethane or any other elastically deformable material, i.e. after the impact or crash the insert returns to the original shape or structure with a given time-constant. However, this kind of insert does not entirely dissipate the energy generated by the impact.

The main object of the invention consists in providing footwear with enhanced protection capacity against impacts or crashes.

This and other objects are achieved through a footwear able to protect the foot against the impact with an external body, such footwear comprising a protective component adapted to deform itself under pressure from the foot and/or external body during an impact, characterized in that the protective component has a permanently and irreversibly alterable structure capable of reacting to said pressure through a structural alteration which absorbs and at the same time dissipates the energy received during the impact.

Hence, an obvious advantage of this invention is that all the energy received by the protection component upon impact is dissipated, basically with zero energy returned. This implies clear benefit in terms of safety, given that the returned energy corresponds to a counter-impact against the foot.

The protective component may comprise a hollow structure adapted to yielding and deforming permanently under said pressure (generated by the collision). Thus the energy received during the collision is dissipated through the deformation of the protective component (and also in the form of heat). Given that the cavity yields and it has no pre-impact status memory, the returned energy is practically zero.

The effect of the hollow structure can be advantageously modulated in case the hollow structure comprises walls delimiting two or more void volumes. Therefore, in case of impact, sequential and progressive deformation of sub-cavities can be provided in order to modulate the energetic absorption efficiency of the protective component.

Thus, in this case, it is advantageous to structure the protective device with parallel yielding walls and to position them on planes basically perpendicular to a possible impact force directrix (for instance a pack of separated layers). Thus, gradually as the impact develops, a wall yields (and/or breaks) subsequently one after the other, and so on.

Therefore, making the protective component with a material able to permanently bend under said pressure might be very convenient.

Another option, suitable even in combination with the previous one, consists in making the protective component using fragile material capable of irreversibly breaking under said pressure. In this case, the energy received upon impact is directed to the breakage of the protective component (or its parts): such energy is not returned but entirely dissipated.

Advantageously, the protective component may consist of an insert which can be removably coupled with the footwear, such component being preferably housed in a seat within the footwear, positioned not in sight. Hence, once damaged by the crash, the insert can be replaced with a new one. Though internal, the seat may be accessible, for instance by making a wall thereof removable, in order to place or replace an insert therein.

In order to support the action of the protective component, even the seat holding it may have protective characteristics similar and/or different to the same protective device. An efficient solution consists in making at least one wall of the seat in a way to yield under said pressure. Therefore, even the walls of the seat can dissipate energy of the impact.

Advantageously, the protective component may be made using a unique material, a mix of materials or made up of various layers of different materials. In addition, a elastic member can be provided, coupled with the insert, having elastic behaviour, in a way to cushion light impacts. Hence, the braking of the protective component is saved only for cases of heavy impacts, thus avoiding continuous replacement. Obviously, the intervention thresholds of each part and/or material of the protective component are to be tested and/or designed depending on both on the end use, the footwear to be made and its topology.

Preferably, at least one wall of the seat has a thin strip adapted to bending under said pressure. This ensures that it is the strip, and not the foot, that impacts against the insert, thus guaranteeing higher safety conditions.

Optionally, there can be calibrated-rupture rigid connection points between the thin strip and at least one wall. Such connection points should be designed in a way to break under said pressure leaving the thin strip free to bend and abut against the insert. Hence the maximum load beyond which the strip should be released and thus the intervention threshold of the protective device can be defined.

Aspects and advantages of the present invention will appear more clearly from the following description, given as an illustrative example, with reference to the appended drawings in which.

With reference to the figures, 10 indicates a boot (only partially showed), with a hull 30, a tread 40 and an insert 20, interposed between the first two.

Figure 1:
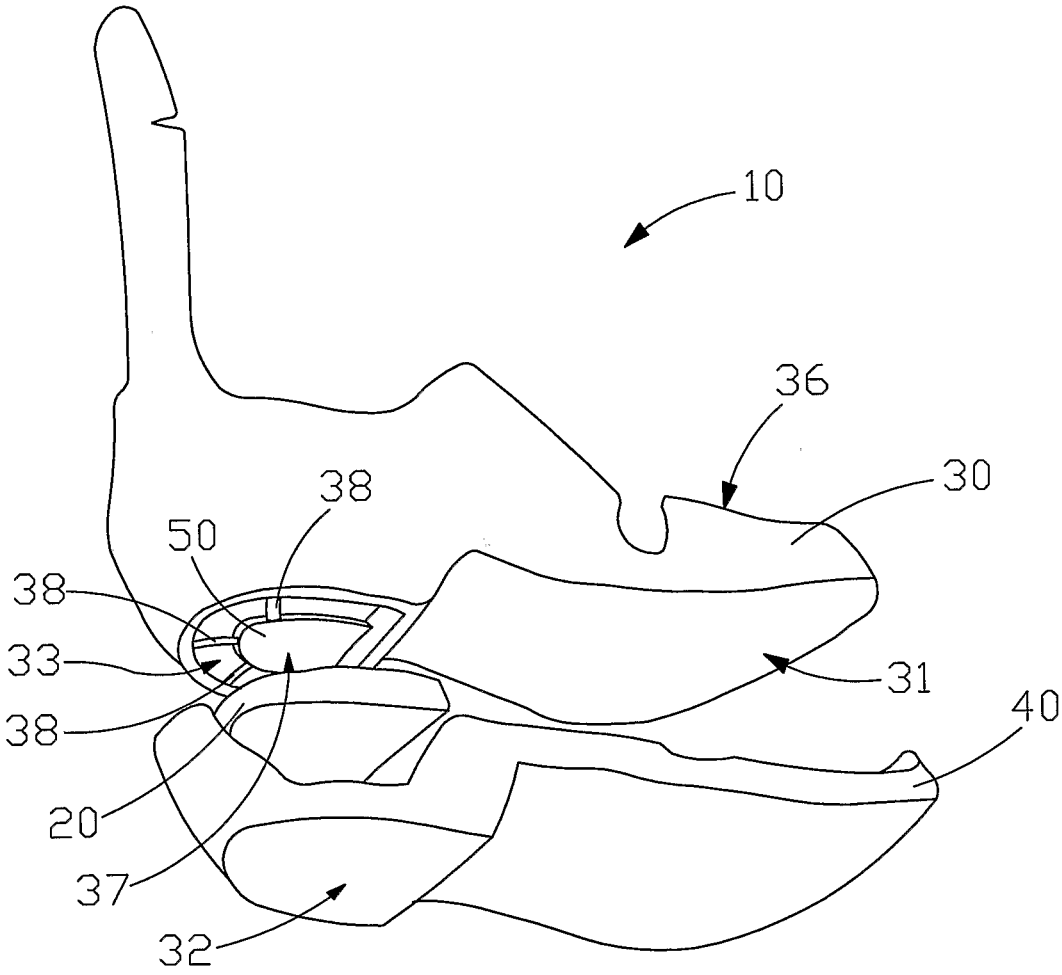
FIG. 1 is an exploded view of a motorcycling boot according to the invention.
Figure 2:
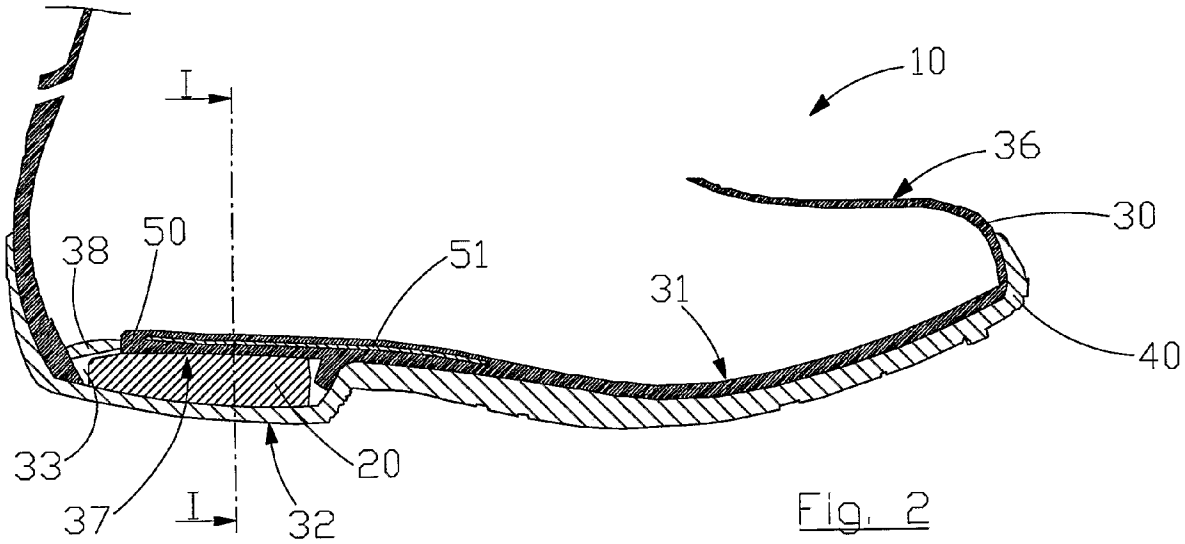
FIG. 2 is a schematic view of a longitudinal section (from heel to tip) of the boot of FIG. 1 assembled.
Figure 3:
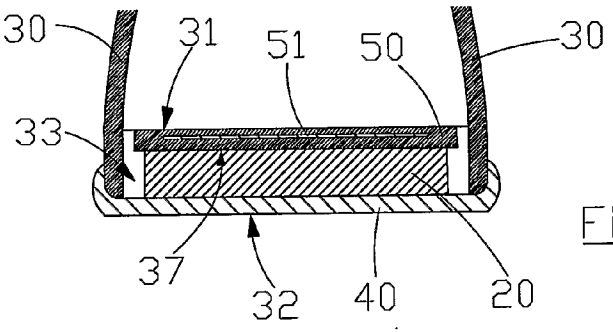
FIG. 3 is a schematic view of a section of the boot of FIG. 1 according to plane I-I in FIG. 2.

Instead of having an upper coupled with a sole (possibly provided with a separate tread) as in traditional footwear, the boot 10 provides for the hull 30 to be monolithic and made as an integral single piece using rigid material such as an injected plastic material. Completed with appropriate covering elements (not shown) the boot 10 accommodates the rider's foot, possibly fitted into a textile footwear (see FIG. 2). The hull 30 comprises an upper top part 36, and a sole lower part 31, into which a metal plate (or core) 51 can be embedded (FIG. 3) with a reinforcing function. In the zone corresponding to a heel 32, the sole 31 has a seat 33 receiving the insert 20. The bottom wall 37 of the seat 33 is made so as to yield under pressure against it by the heel. In fact, it comprises a strip (or tongue) 50 capable of bending under said pressure. The strip 50 may comprise the whole or part of the plate 51 and it is permanently connected to the perimeter of the seat 33 through rigid connection peripheral points (or bridges) 38 (for instance obtainable during moulding). On the lower part of boot 10, the tread 40 couples with the entire lower surface of the sole 31, so as to also cover the insert 20 and hold it in the seat 33 (FIG. 2).

The insert 20 is a substantially parallelepiped element, with rounded edges, made of material with fragile behaviour, i.e., when subject to an external force exceeding its breaking load it breaks without carrying out any plastic deformation. Such breakage ensures excellent dispersion of the impact energy. The material used should be chosen depending on the breaking load required, which will define the protective intervention threshold of the insert.

Figure 4:
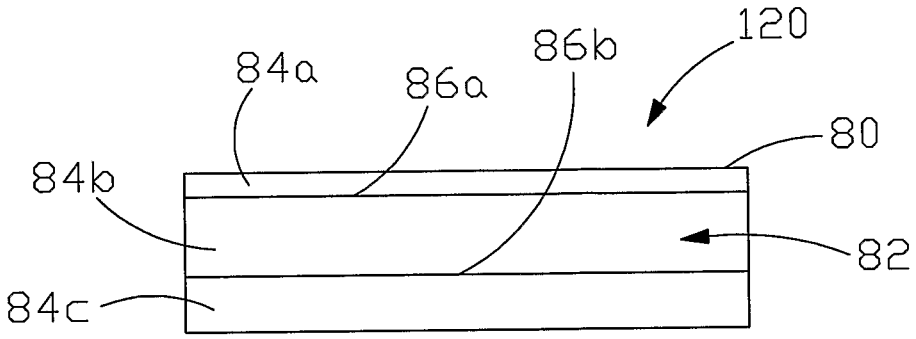
FIG. 4 is a side section view of an insert according to the invention.
Figure 5:
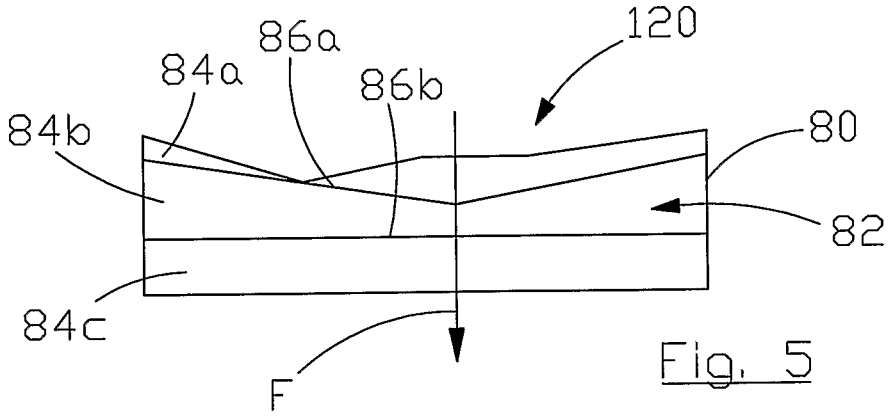
FIG. 5 is a view of the insert of FIG. 4 at the beginning of an impact.
Figure 6:
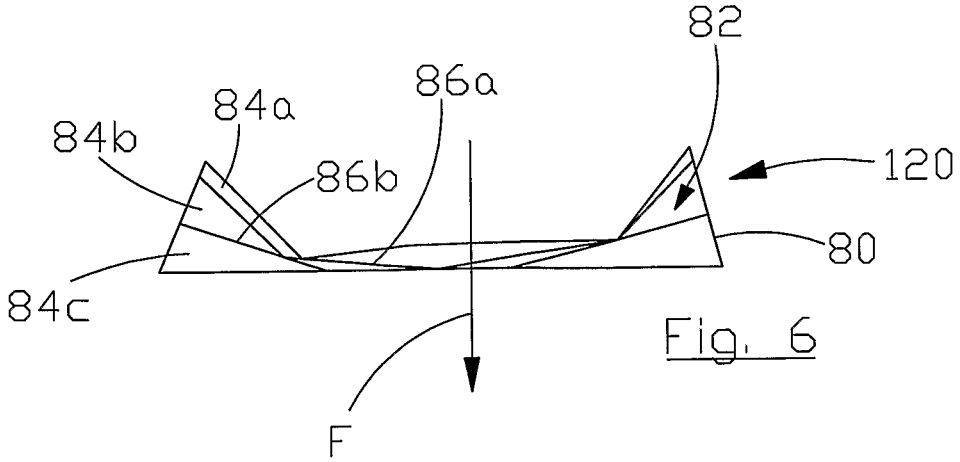
FIG. 6 is a view of the insert of FIG. 5 at the end of an impact.

According to a different embodiment of the invention (see FIGS. 4-6), an insert 120 may be made of ductile material and lacking elastic behaviour (and return) (FIG. 4). It comprises an external parallelepiped case 80 which defines an internal cavity 82. Such cavity is divided into sub-cavities 84*a*, 84*b*, 84*c* by two yielding walls 86*a*, 86*b*. An impact towards direction F (see FIGS. 5 and 6) first causes wall 86*a*, then wall 86*b* to collapse (and/or break) sequentially. It is clear how the partition into void volumes 84*a,b,c* and the mechanical characteristics of the walls 86*a*, 86*b* allow to determine the behaviour of the insert 120 during the impact, thereby modulating its intervention thresholds and its responses to the impact.

Figure 7:
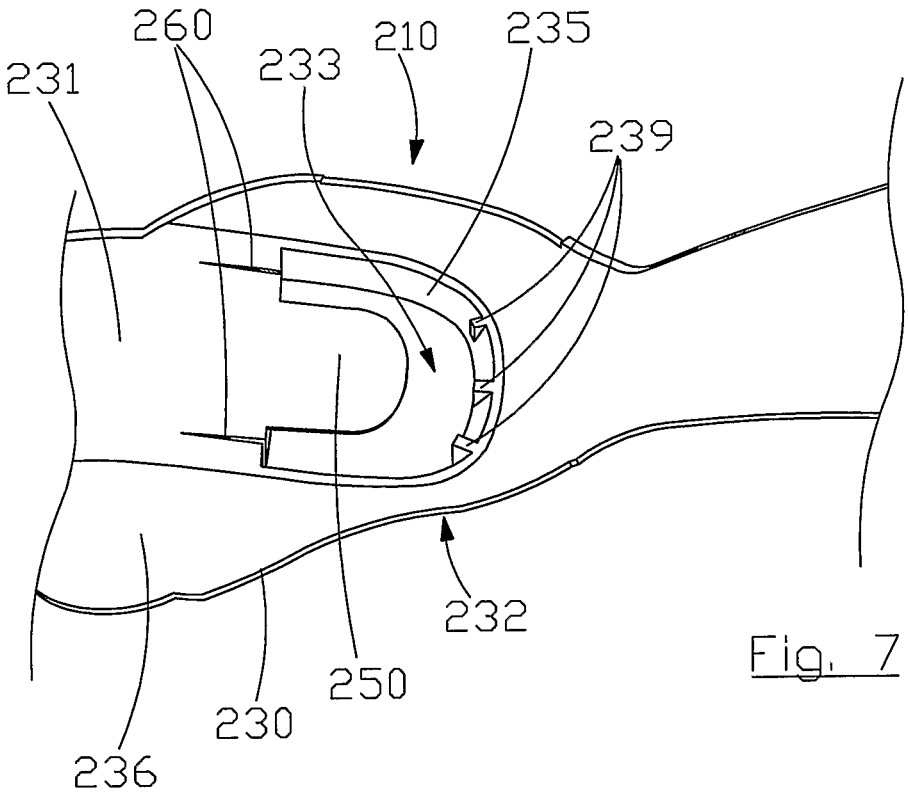
FIG. 7 is a view of the inner part of a variant of the boot without the insert.
Figure 8:
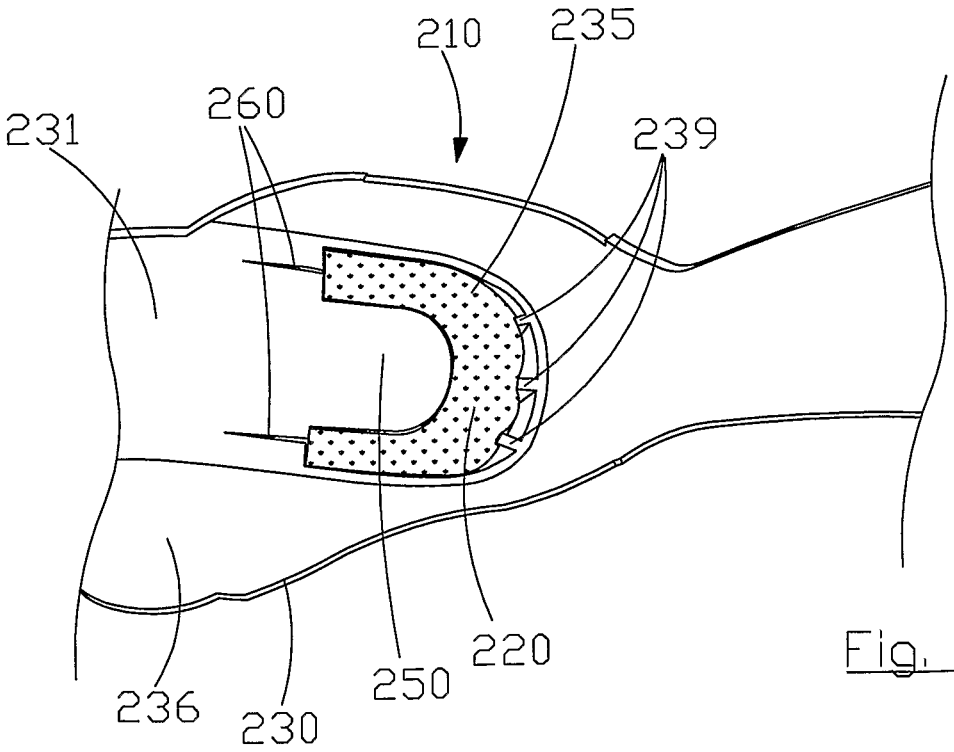
FIG. 8 is a view of the inner part of a variant of the boot with the insert.

According to a further embodiment of the invention, (see FIGS. 7, 8) a hull 230 of a boot 210 comprises an upper top part 236—, and a sole lower part 231. A seat 233 is obtained in a region of the heel 232 of the sole 231 and it is defined by a peripheral edge 235 and a flexible, floating strip 250.

Similarly to the first embodiment, an insert 220 (FIG. 8) is accommodated in the seat 233, blocked on the upper side by the strip 250 and on the lower side by a tread not illustrated in the figures.

There are three teeth 239, protruding from the rear portion of the peripheral edge 235, adapted to holding the insert 220 permanently in the seat 233.

In opposite position to the protruding teeth 239, there are two cuts 260 running through the entire thickness of the sole 231, extending parallel along the length of the strip 250. The cuts 260 guarantee greater flexibility of the strip 250, and also of a part of the sole 231.

A boot according to the invention is very useful for sports activities such as motocross, where the rider is often subject to vertical falls leading to impacts against the heels. By impacting against the inserts 20, 120, 220, the heel breaks or deforms the inserts. This leads to the substantially complete absorption and dissipation of the energy generated during the collision, thereby reducing the rider's risks of injury or at least reducing risks of heel fracture. The heel 32, 232 is capable of elastically cushioning light impacts thanks to the oscillating strip 50, 250, while impacts of grater magnitude are absorbed by the intervention of the insert 20,120,220.

In addition, in the first and second embodiments, the energy developed may be dissipated even through breakage of the connection points 38. In fact, should the amount of the force exerted by the heel on the insert 20, 120 exceeds the static reaction of the points 38, the latter break dissipating energy irreversibly. Before and/or after such breakage, the strip 50 can be made in a way that it may be able to oscillate, thus cushioning the impact (and the points 38 may be slightly elastic allowing the strip to bend slightly).

Functionally or conceptually equivalent modifications and variants are possible and can be provided within the scope of the invention as defined by the subsequent claims. For instance, according to the invention, one or more protection devices can be positioned not only on the heel region but also in other parts of the footwear.

The invention claimed is:

1. Motorcycle boot for protecting a foot against impact with an external body, comprising a hull made of plastic material comprising a sole lower part and a reinforcing metal plate, the reinforcing metal plate having a first end embedded in the sole lower part and a second end projecting over a seat wherein a protective component is housed, the protective component being adapted to break without carrying out any plastic deformation under pressure from one or more of the foot and the external body during an impact, wherein the protective component absorbs a magnitude of energy from the impact and is blocked on an upper side by the second end of the metal plate;

and wherein two cuts run through an entire thickness of the sole lower part and extend parallel along a length of the first end of the reinforcing metal plate so as to make the metal plate able to oscillate for cushioning the foot during light impacts to the motorcycle boot.

2. The motorcycle boot according to claim 1, wherein the seat is obtained in the sole and defined by a peripheral edge, wherein a plurality of teeth protrude from a rear portion of said peripheral edge in order to hold the protective component in the seat.

3. The motorcycle boot according to claim 1, wherein the magnitude of energy from the impact is greater than a magnitude of energy from the lighter impacts.

4. The motorcycle boot footwear according to claim 3, wherein the magnitude of energy from the impact is sufficient to cause injury to heel of foot without use of the protective component.

5. The motorcycle boot according to claim 1, wherein the protective component by collapsing dissipates the magnitude of energy absorbed, preventing transfer of the energy to the foot.

6. The motorcycle boot according to claim 1, wherein the second end of the metal plate is connected to the sole lower part.

7. The motorcycle boot according to claim 6, wherein the second end of the plate is embedded in the sole lower part.

8. The motorcycle boot according to claim 1, wherein the second end of the metal plate is positioned so to float on the upper side of the protective component.

9. The motorcycle boot according to claim 1, wherein the protective component comprises an insert that is held within the seat yet freely removable and thereby replaceable after collapsing with another like protective component.

10. The motorcycle boot footwear according to claim 9, wherein the protective component is held within the seat via a plurality of teeth protruding from a peripheral edge of the seat.

11. The motorcycle boot according to claim 1, where the protective component when housed in the seat is entirely concealed from sight.

12. The motorcycle boot of claim 1, wherein when portion of sole lower part extending between the two cuts is made to move during light impacts, such portion oscillates together with the second end of the metal plate.

* * * * *